US005274544A

United States Patent [19]

Iida

[11] Patent Number: 5,274,544

[45] Date of Patent: Dec. 28, 1993

[54] SINGLE-PASS MULTICOLOR THERMAL TRANSFER

[75] Inventor: Akihiko Iida, Kawasaki, Japan

[73] Assignee: Ricoh Company, Ltd., Tokyo, Japan

[21] Appl. No.: 964,054

[22] Filed: Oct. 21, 1992

[30] Foreign Application Priority Data

Oct. 24, 1991 [JP] Japan ..... 3-305451
Aug. 18, 1992 [JP] Japan ..... 4-240097

[51] Int. Cl.[5] ..... B41J 2/32
[52] U.S. Cl. ..... 346/76 PH; 400/120
[58] Field of Search ..... 346/76 PH; 400/120, 400/223, 224.1, 224.2, 234, 235, 236, 236.1, 236.2, 225, 231, 232

[56] References Cited

FOREIGN PATENT DOCUMENTS 58-119895 7/1983 Japan .
63-11368 1/1988 Japan .
0297280 11/1989 Japan ..... 400/120

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

A transfer type recording apparatus for recording a multi-colored picture, which apparatus is miniaturized in size and, without improving an efficiency of multi-transfer of an ink sheet, is capable of forming a longer picture than in previous technology. The recording apparatus comprises a plurality of recording heads, conveying mechanisms for a print sheet and an ink sheet, and guide rollers located between each thermal head. The ink sheet is conveyed at a slower speed than the print sheet. The guide roller guides the ink sheet, positioned between adjacent thermal heads, apart from the print sheet.

12 Claims, 16 Drawing Sheets

SINGLE-PASS MULTICOLOR THERMAL TRANSFER

BACKGROUND OF THE INVENTION

The present invention relates to a thermal transfer type recording apparatus which can print a picture in a plurality of colors, and more particularly to a thermal transfer type recording apparatus which has a plurality of recording heads and is used with an ink sheet having a plurality of color regions.

A thermal transfer type recording apparatus that has a plurality of recording heads and is used with an ink sheet having a plurality of color regions, is used as, for example, a printer, a copy machine or a facsimile machine. This type of recording apparatus can realize a high speed printing as it adopts a plurality of recording heads. Further, in this type recording apparatus, printing of a picture can be performed by conveying an ink sheet slower than a sheet on which a picture is to be printed (hereinafter called print sheet), and thus efficiency of utilization of the ink sheet is improved, resulting in minimizing a running cost for the apparatus.

Such a heat transfer type recording apparatus is suggested in the Japanese Patent Publication No. 3-2675. However, the recording apparatus suggested in the above publication has a relatively large space between recording heads, and this results in a problem in that the overall size of the apparatus becomes large. The reason of this problem will be explained below.

Now supposing that L is an interval between recording heads, S is a length of an ink sheet located between the recording heads, A is a pitch of each color region on the ink sheet in a conveying direction of the ink sheet, Q is a length of picture to be printed on a print sheet in a conveying direction of the print sheet, and a conveying speed of the ink sheet is $1/n$ $(n>1)$ of a conveying speed of the print sheet. Minimizing the size of the apparatus is restricted by the interval between recording heads L which is determined by the picture length Q and the value n. In the above mentioned recording apparatus, since L is set to S, $L=Q/(n-1)$, and $Q=n*A$, the interval between recording heads L is automatically determined by Q and n. For example, in case n is fixed to a certain value and it is attempted to obtain a longer length of picture, L becomes large and thus the size of the recording apparatus is increased. Accordingly, in order to increase the length Q without increasing the size of the apparatus, n should be made larger. However, the multi-transfer performance of the ink sheet has to be improved so as to allow for a larger n, and that is a technically difficult matter.

Additionally, in the above mentioned recording apparatus, since the interval L and the picture length Q are proportional to each other, the picture length Q is automatically determined when the value of n and the interval L are fixed. It is therefore not possible to form pictures having a variety of lengths by using one apparatus.

In the mean time, there has been suggested, in the Japanese Laid-Open Patent Application No. 63-11368, a heat-transfer type recording apparatus that eliminates utility efficiency decreases due to existence of space between each color region on an ink sheet. This is achieved by setting a length of each color region in a conveying direction to a length sufficient to form a plurality of pictures. This recording apparatus has only one recording head. If a plurality of recording heads are used in order to attempt increasing of recording speed, the overall size of the recording apparatus becomes extremely large similar to the recording apparatus suggested in the Japanese Patent Publication No. 3-2675.

Further, in the recording apparatus suggested in the Japanese Laid-Open Patent Application No. 63-11368, since each color region has a length sufficient to form a plurality of pictures, the ink sheet is required to be rewound in considerable length. This winding operation causes forming of winkles on the ink sheet and increases a recording time.

SUMMARY OF THE INVENTION

It is a general object of the present invention to provide a novel and useful heat-transfer type recording apparatus in which the above mentioned disadvantages are eliminated.

A more specific object of the present invention is to provide a heat-transfer type recording apparatus having a plurality of recording heads so as to form a multi-colored picture which can be minimized in overall size, and which apparatus can form a longer picture without improving an efficiency of multi-transfer of an ink sheet.

Another object of the present invention is to provide a heat transfer type recording apparatus which can eliminate the forming of wrinkles on an ink sheet and which apparatus can eliminate increases of recording time when each color region of the ink sheet has a length sufficient to form a plurality of pictures.

A further object of the present invention is to provide a heat-transfer type recording apparatus in which a length of the picture can be freely changed.

In order to achieve the above mentioned objects, a transfer-type recording apparatus according to the present invention used with an ink sheet on which color regions comprising m colors are repeatedly formed in a predetermined order and records a picture by transferring the m colors onto a print sheet, comprises:

a first conveying means conveying the print sheet;

a second conveying means conveying the ink sheet at $1/n$ of a conveying speed of the print sheet in a conveying direction of the print sheet, where n is a number larger than 1;

m number of recording heads, provided at a predetermined intervals in a conveying direction of said print sheet, transferring each of said m colors of the ink sheet onto the print sheet while pressing the ink sheet onto the print sheet, where m is an integer equal to or larger than 2; and a guiding means for guiding portions of the ink sheet positioned between adjacent pairs of the recording heads so as to be away from said print sheet;

wherein, each of the color regions of said ink sheet has a length sufficient to form k number of pictures in the conveying direction of the print sheet, where k is an integer equal to or larger than 1, and the following relations are satisfied, $$S>L$$

$$L=n*(S-A)$$

where,

L is a distance between adjacent ones of the recording heads,

S is a length of a portion of the ink sheet positioned between adjacent pairs of the recording heads, and A is a pitch of said color regions of the ink sheet in the conveying direction of said print sheet.

According to the present invention mentioned above, the size of the apparatus can be miniaturized by shortening the interval between the recording heads by having the guide rollers between the recording heads; a larger picture can thus be recorded without needing to improve efficiency of the multi-transfer performance.

Additionally, forming of wrinkles on the ink sheet is eliminated, and also an increase in the recording time is prevented when each color region of the ink sheet has a length which can form a plurality of recorded pictures.

Further, a length of the picture to be formed can be freely changed and thus pictures having various lengths can be recorded by using one apparatus.

Other objects, features and advantages of the present invention will become more apparent from the following detailed description when read in conjunction with the accompanying drawing.

DESCRIPTION OF THE PREFERRED EMBODIMENTS

Figure 1:
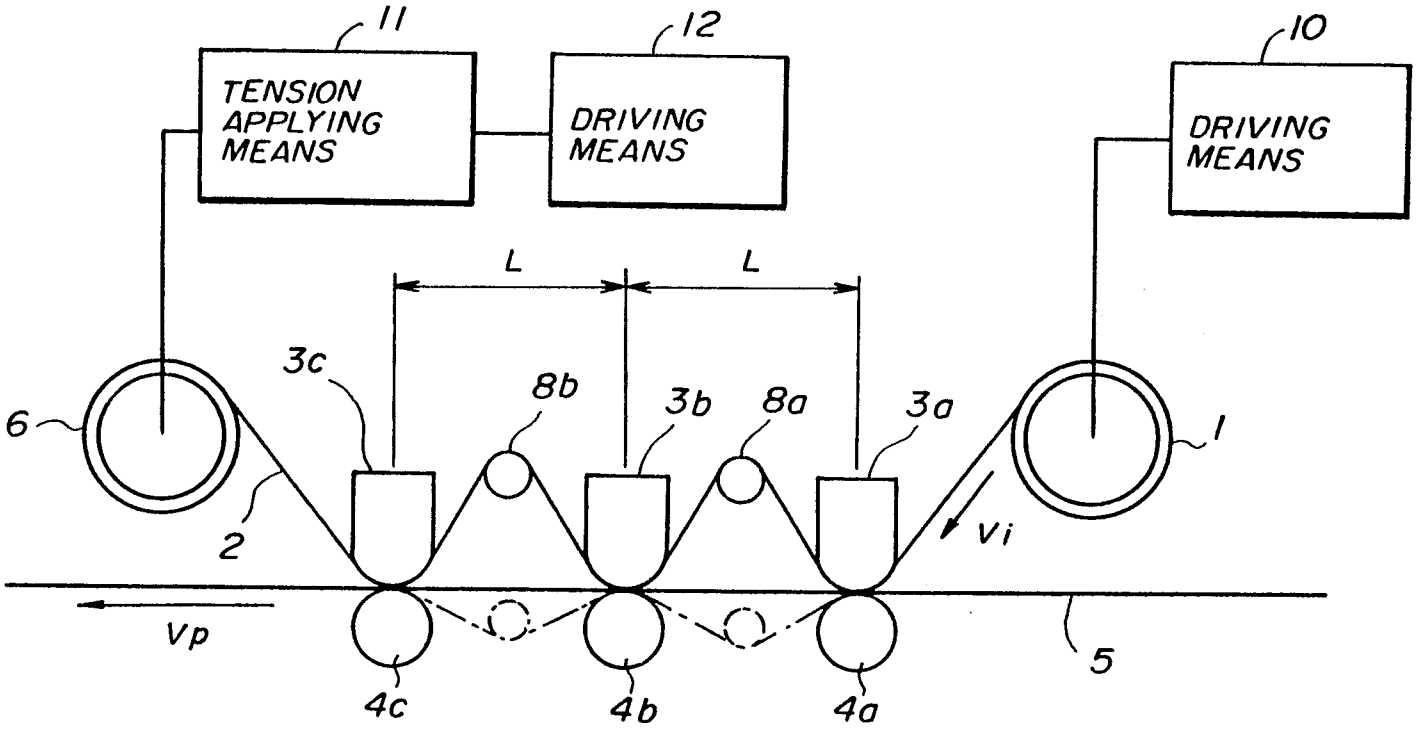
FIG. 1 is a schematic view of a first embodiment of a heat-transfer type recording apparatus according to the present invention.

FIG. 1 is a schematic view of a first embodiment of a heat-transfer type recording apparatus according to the present invention. A reference numeral 5 indicates a print sheet such as, for example, a print paper. The print sheet 5 is conveyed in a direction from right to left in the drawing at a speed of VP when recording a picture.

There are provided three thermal heads 3*a*,3*b*,3*c* aligned along the conveying direction of the print sheet 5. Each thermal head 3*a*,3*b*,3*c* has a number of heat generating elements, not shown in the figure, arranged in a direction perpendicular to the plane of the drawing at a tip of the thermal heads. Platens 4*a*,4*b*,4*c* are respectively located opposite to each thermal head.

The thermal heads 3*a*,3*b*,3*c* shown in FIG. 1 are one example of a recording head but other recording heads such as an electric recording head for example can be used in the following embodiments.

In this embodiment, although each platen 4*a*,4*b*,4*c* comprises a roller, other types of platen can be adopted, or a commonly used platen can be used for a plurality of thermal heads. For example, a structure that includes a drum shaped platen and a plurality of thermal heads arranged along a circumference of the platen may be used.

As shown in FIG. 1, an interval between adjacent ones of the thermal heads 3*a*,3*b*,3*c*, more precisely, an interval between adjacent ones of the heat generating elements on each thermal head, and an interval between adjacent ones of the platens 4*a*,4*b*,4*c* are set to L. In this embodiment, a length of the conveying path of the print sheet between adjacent pairs of thermal heads becomes L.

A reference numeral 2 in FIG. 1 indicates an ink sheet. This ink sheet 2 is supplied from supplying roll 1, on which the ink sheet is wound. The ink sheet is conveyed at a speed of Vi. The supplied ink sheet 2 is conveyed between the thermal heads 3*a*,3*b*,3*c* and the platen 4*a*,4*b*,4*c*, and is wound on a wind roll 6.

Figure 2:
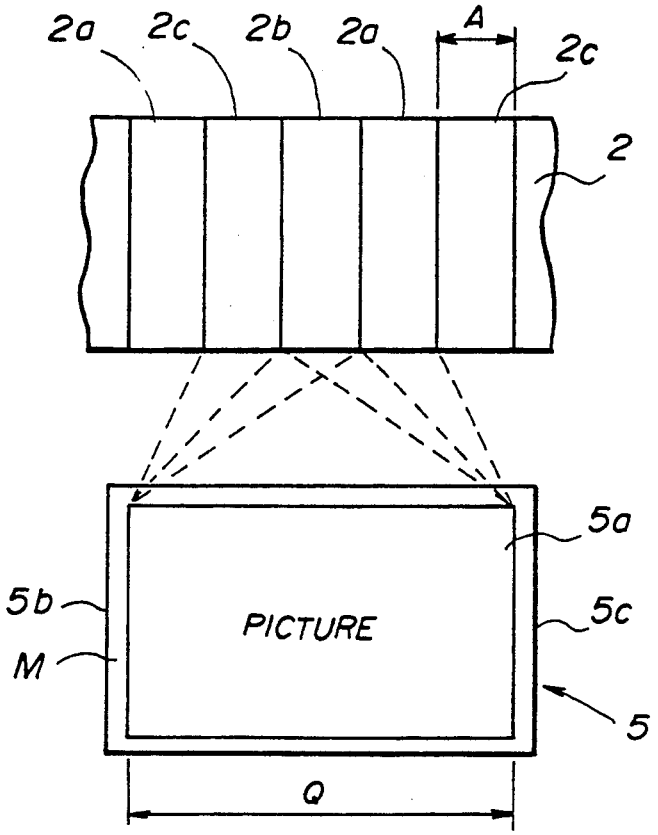
FIG. 2 is a view for explaining a relationship between color regions of an ink sheet and a recorded picture.
Figure 4:
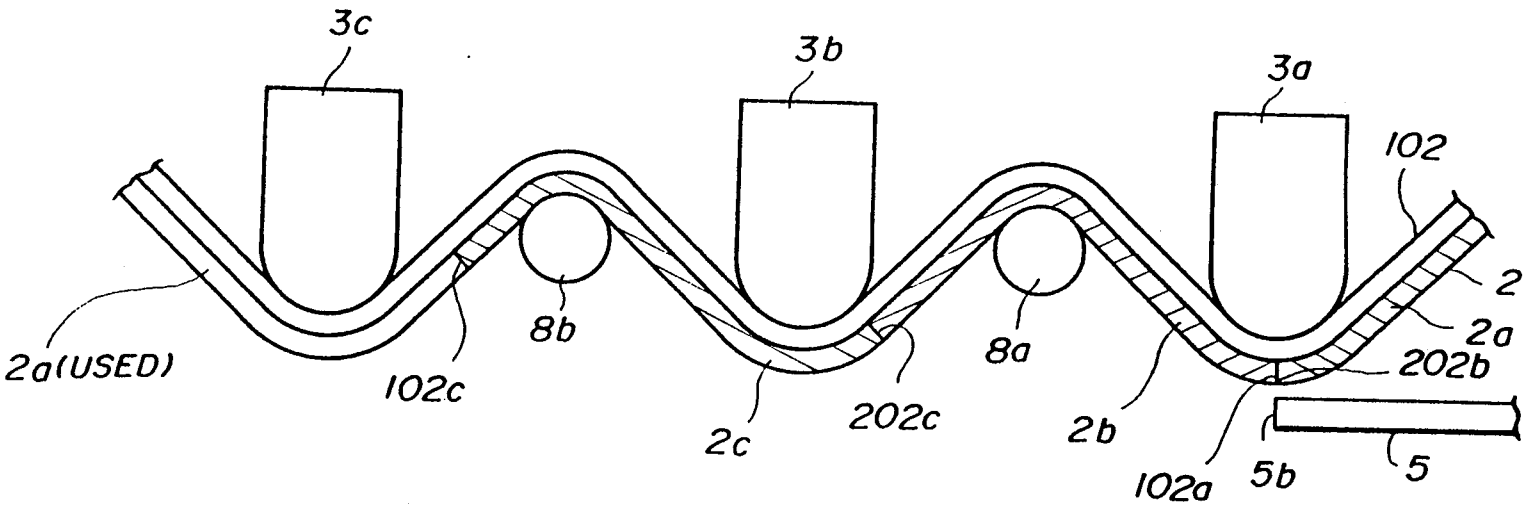
FIG. 4 is a view for explaining an operation of a first embodiment according to the present invention.

The ink sheet 2 comprises, as shown in FIGS. 2 and 4, a flexible thin sheet base 102 on which color regions 2*a*,2*b*,2*c*, each comprising a layer made of a thermal-melting type or a thermal-sublimating type ink or dye, are provided.

On the sheet base 102, there are, repeatedly formed, color regions each having m colors along a conveying direction of the ink sheet 2, where m is an integer equal to or larger than 2. In this embodiment, m is set to 3 and, as shown in FIG. 2, sets comprising three color regions 2*a*,2*b*,2*c* are repeatedly formed in turn in a conveying direction of the ink sheet 2. For example, the first color region 2*a* may be yellow, the second 2*b* magenta, and the third 2*c* cyan. The above mentioned thermal heads arranged at intervals L are provided in m pieces, which number m is the same as a number of the color regions. Accordingly, in this embodiment, three thermal heads 3*a*,3*b*,3*c* are provided.

When recording a picture on the print sheet 5, the ink sheet 2, supplied from the supplying roll 1, and the print sheet 5, supplied from a paper feeder, not shown in the figure, are conveyed in the same direction between each thermal head 3*a*,3*b*,3*c* and the respectively positioned platens 4*a*,4*b*,4*c*. Each platen rotates counterclockwise. The print sheet 5 and the ink sheet 2 are pressed against each other at sandwiched portions (where the thermal heads and respective platens face each other), and the ink sheet 2 conveyed to the left side of the thermal head 3*c* is eventually wound on the wind roll 6.

Although in this embodiment the ink sheet 2 and the print sheet 5 are continuously conveyed, they can, alternatively, be intermittently conveyed. In this alternative case, the speed Vi of the ink sheet 2 and the speed Vp of the print sheet 5 are represented by their average speed.

The heat generating elements on the thermal heads 3*a*,3*b*,3*c* selectively generate heat, and the ink or dye of each color region on the ink sheet 2 is melted or sublimated by the heat, and is then transferred onto the print sheet 5. Eventually, a multi-colored picture is formed on the print sheet 5.

FIG. 2 shows a picture 5a formed on the print sheet 5. This picture 5a is formed in m colors, as described in the following. In this embodiment, the picture 5a is formed in one set of colors consisting of color regions 2a,2b,2c. The interval L is determined so that each thermal head 3a,3b,3c transfers the ink or dye of a different color region. That is, the first thermal head 3a applies a heat to the first color region 2a, the second thermal head 3b to the second color region 2b, and the third thermal head 3c to the third color region 2c. A notation A in FIG. 2 indicates a pitch of each color region 2a,2b,2c in the conveying direction of the ink sheet 2, and a notation Q indicates a length of the picture 5a in a conveying direction of the print sheet 5.

As mentioned above, a picture recording is performed while the ink sheet 2 and the print sheet 5 are conveyed at a respective speeds Vi and Vp. The ink sheet 2 is conveyed at a slower speed than the print sheet 5. That is, the conveying speed Vi of the ink sheet 2 is 1/n of conveying speed Vp of the print sheet 5, where n in larger than 1 ($n>1$). In this manner, the ink sheet 2 is conveyed at a slower speed than that of the print sheet 5, and that results in each color region 2a,2b,2c on the ink sheet 2 being used n times. By this feature of combination of the ink sheet 2 and the conveying speed, consumption of the ink sheet is reduced, and thus a running cost for the recording apparatus can be reduced.

In this embodiment, as shown in FIG. 1, the supply roll 1 of the ink sheet 2 is rotationally driven by a first driving means 10, which comprises a stepping motor or a DC motor, an encoder and a reduction mechanism. The wind roll 6 is rotationally driven by a second driving means 12 via a tension applying means 11, which comprises an electro-magnetic powder clutch or a frictional clutch. It is to be noted that the supply roll 1 and the wind roll 6 can be driven by a single driving means.

It is natural that the conveying speed Vi of the ink sheet 2 is equal to the circumference speed VB of the supply roll 1. When the supply roll 1 is directly connected to the first driving means 10, which drives the roll in a constant rotational speed, the circumference speed of the supply roll 1 is reduced, as a diameter of the roll of the ink sheet 2 is reduced. Accordingly, the conveying speed Vi of the ink sheet 2 is also reduced. However, in most cases, an overall length of the ink sheet 2 is enough to form about one hundred pictures 5a shown in FIG. 2, thus the change in diameter of the supply roll 1 of the ink sheet 2 is negligibly small. Therefore, a change in concentration of pictures caused by a change in diameter of the roll can be usually ignored.

In case a longer ink sheet is used, or the concentration of pictures is greatly affected by a conveying speed of the ink sheet, the conveying speed Vi of the ink sheet should be maintained constant even if the diameter of the supply roll 1 changes. In such a case, the rotational speed of the first driving means 10 may be controlled by means of detecting the diameter of the supply roll or counting a number of pictures already formed. It is also considered that, as described in the later, a capstan roller may be used to maintain constant the conveying speed of the ink sheet.

A construction of the wind roll 6 driven by the driving means 12 via the tension applying means 11 is such as to apply a tension to the ink sheet 2 so as to achieve a stable conveyance. In a state where no tension is applied to the ink sheet 2 at the wind roll 6, that is, the ink sheet is not loaded to the wind roll 6, the wind roll 6 is driven, by the second driving means 12, at a speed faster than that of the supply roll 1. In other words, the circumference speed VF of the wind roll 6 and the circumference speed VB of the supply roll 1 are determined so as to satisfy $VF>VB$ when no load is applied to the either rolls.

On the other hand, when the wind roll 6 winds the ink sheet 2 while forming a picture, a tension is applied to the ink sheet 2 due to the difference of speed between the supply roll 1 and the wind roll 6. In this state, the tension applying means 11 reduces the speed of the wind roll 6 until the speed of the wind roll 6 becomes equal to the speed of the supply roll 1. That is, $VF=VB=Vi$ is satisfied. The reduction of the speed of the wind roll 6 can be obtained, in case the tension applying means 11 comprises a clutch means, by slippage of the clutch means.

It is to be noted that when the driving means 12 comprises a DC motor, the tension applying means 11 can be omitted because of the slippage of the DC motor itself.

As mentioned above, in the conventional recording apparatus, since the interval L between the thermal heads becomes large, a problem, that a construction of the apparatus becomes large, cannot be solved. In order to eliminate such a disadvantage, this embodiment is provided with guide rollers 8a and 8b, as a guide means, located between each thermal head 3a, 3b, 3c. The ink sheet 2 is engaged with the guide rollers 8a, 8b so that portions of the ink sheet 2 between each thermal head are some distance apart from the print sheet 5. Each guide roller 8a, 8b can rotate in either direction so as to follow the conveyance of the ink sheet 2 in either direction. The guide rollers 8a, 8b may be coupled with a driving means so as to assist the conveying of the ink sheet 2.

Figure 3:
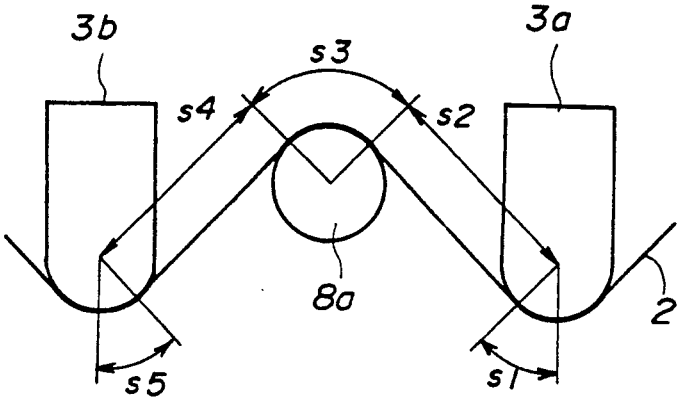
FIG. 3 is a view for explaining a length of an ink sheet located between thermal heads.

In the conventional recording apparatus, a portion of the ink sheet positioned between each thermal head overlaps with the print sheet. On the other hand, in the recording apparatus shown in FIG. 1, portions of the ink sheet 2 between thermal heads 3a, 3b, 3c are engaged with respective guide rollers 8a, 8b located a predetermined distance apart from the print sheet 5. Accordingly, on the assumption that a length of ink sheet 2 positioned between thermal heads 3a, 3b, 3c is S, as shown in FIG. 3, S is calculated by $S=S1+S2+S3+S4+S5$. Apparently, the length S is larger than the length of the path of the print sheet situated between thermal heads 3a, 3b, 3c, that is the interval L between adjacent thermal heads ($S>L$).

In order to form the predetermined picture 5a on the print sheet 5, a length S of the ink sheet 2 is required to be between adjacent thermal heads 3a, 3b, 3c. In the conventional recording apparatus, since an ink sheet and a print sheet overlap with each other, S is naturally equals to L ($L=S$) so as to allow placement of a length S of the ink sheet between adjacent thermal heads. Therefore, L must become large.

On the other hand, by the above mentioned construction of this embodiment, L can be set to be smaller than that of the conventional recording apparatus, in virtue of the guide rollers 8a, 8b that enable the provision of a predetermined length of ink sheet 2 between adjacent thermal heads 3a, 3b, 3c. Accordingly, the interval L between thermal heads can be set without limitations caused by the ink sheet, and thus the construction of the recording apparatus can be miniaturized without sacrifice.

Next, a more specific description will be given of a relationship between S and n, with reference to a description of picture recording operation.

FIG. 4 to FIG. 7 are views for explaining a consecutive operation for forming the picture 5a shown in FIG. 2. In those figures, indication of the platen 4a, 4b, 4c shown in FIG. 1 is omitted for convenience. Additionally, for simplifying the description, as shown in FIG. 2, although usually the print sheet 5 has a margin M at an edge of the sheet and a picture is formed inside the margin M, it is assumed that the picture is formed on the entire surface from a front end 5b to a rear end 5c of the print sheet 5. Further, in FIG. 4 to FIG. 7, three color regions, for explaining an operation in the following are indicated by shaded area, and the color region 2a, which is not shaded, located in the left most side of FIG. 4, is a region which has already been used in the last recording of a picture.

As shown in FIG. 4, the print sheet 5 is supplied from the right side in the figure by a paper feeder, not shown in the figure, and conveyed between the thermal head 3a and the platen 4a (refer to FIG. 1). The front end 5b of the print paper 5 reaches right under a tip of the thermal head 3a where the heat generating elements are located.

In this state, a front edge 102a of the color region 2a of the ink sheet 2 is positioned right under the tip of the thermal head 3a and is pressed onto the front end 5b of the print sheet 5. Then the print sheet 5 begins to be conveyed at the speed Vp and the ink sheet 2 begins to be conveyed at the speed Vi, both in a direction indicated by an arrow (Vi=Vp/n). At this moment, the heat generating elements of the first thermal head 3a selectively generate heat, so as to transfer an amount of ink of the first color onto the print sheet 5. At this time, the second and the third thermal heads 3b, 3c are not yet generating heat.

Figure 5:
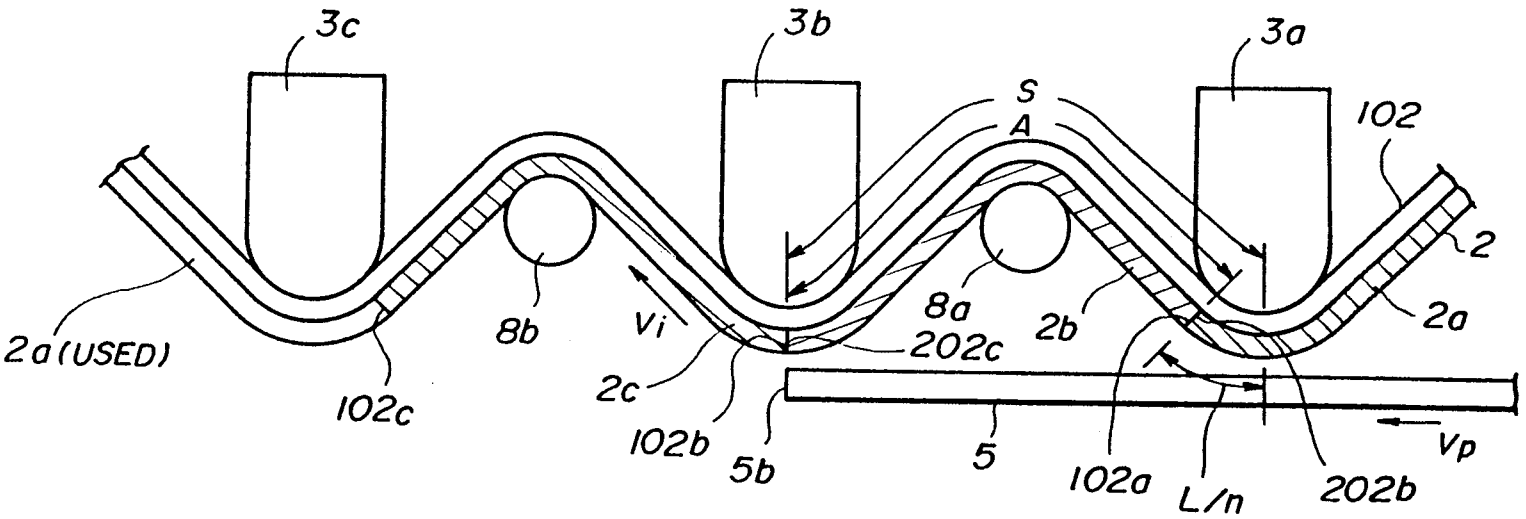
FIG. 5 is a view for explaining an operation of a first embodiment according to the present invention.

Next, as shown in FIG. 5, the front end 5b of the print sheet 5 moves to a position right under the second thermal head 3b. At this moment, the front end 102a of the second color region of the ink sheet 2, the end that was positioned between the thermal head 3a and the thermal head 3b, reaches a position right under the thermal head 3b. Then the heat generating elements provided on the thermal head 3b start selectively generating a heat so as to transfer an amount of ink of the second color onto the print sheet 5.

Figure 6:
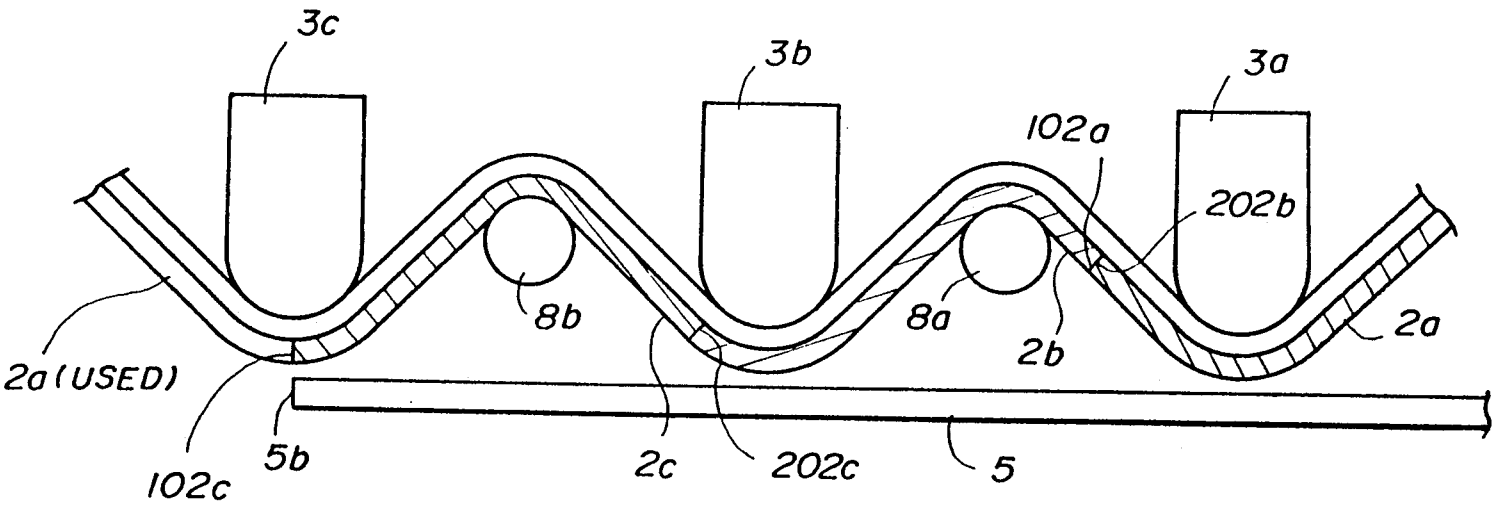
FIG. 6 is a view for explaining an operation of a first embodiment according to the present invention.

In the same manner, as shown in FIG. 6, the front end 5b of the print sheet 5 moves to a position right under the third thermal head 3c. At this moment, the front end 102a of the third color region of the ink sheet 2 reaches a position right under the thermal head 3c. Then the heat generating elements provided on the thermal head 3c start selectively generating heat so as to transfer an amount of ink of the third color onto the print sheet 5.

Figure 7:
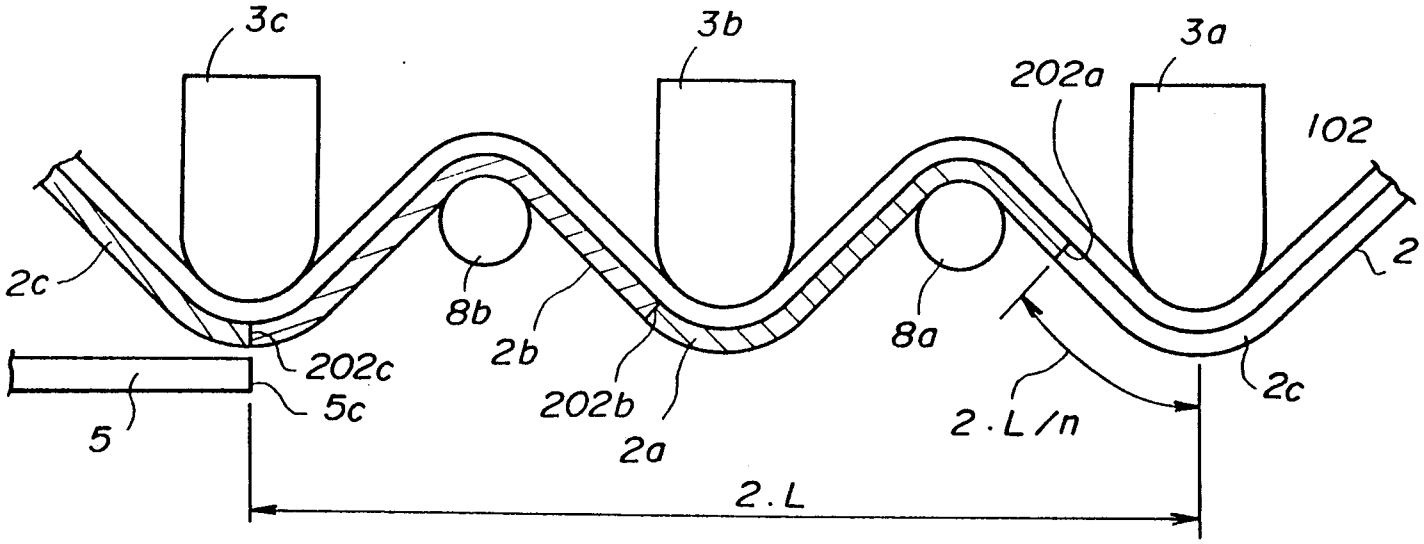
FIG. 7 is a view for explaining an operation of a first embodiment according to the present invention.

In this manner, multi-colored pictures comprising combination of three colors are superimposed on the print sheet 5, and eventually, the multi-colored picture 5a is formed on the print sheet. FIG. 7 shows a state where the rear end 5c of the print sheet 5 reaches right under the last thermal head 3c and an operation of forming one picture is complete.

In the above mentioned consecutive operations of forming pictures, the heat generating elements on each thermal head 3a, 3b, 3c generate heat until each rear end 202a, 202b, 202c of the color regions, respectively, reaches a position right under each thermal head 3a, 3b, 3c. That is, the first thermal head 3a is activated from the time when the front end 102a of the first color region 2a reaches a position right under the first thermal head 3a until the time when the rear end 202a of the first color region 2a reaches a position right under the first thermal head 3a. The second thermal head 3b is activated from the time when the front end 102b of the second color region 2b reaches a position right under the second thermal head 3b till the time when the rear end 202b of the second color region 2b reaches a position right under the second thermal head 3b. The third thermal head 3c is activated from the time when the front end 102c of the third color region 2c reaches a position right under the third thermal head 3c until the time when the rear end 202c of the third color region 2c reaches a position right under the third thermal head 3c.

While the operation proceeds from FIG. 4 to FIG. 5, the print sheet 5 is conveyed a distance equal to the interval L between the thermal heads 3a and 3b. Meanwhile, the ink sheet 2 is conveyed a distance of L/n because its conveying speed Vi is 1/n of the conveying speed Vp of the print sheet 5. As mentioned above, a length of each color region 2a, 2b, 2c in a conveying direction of the ink sheet 2 is A, and a length of the portion of the ink sheet 2 positioned between the thermal heads 3a and 3b is S. Apparent from FIG. 5, the following equation is established between the length S and the length L.

$$L/n=S-A \quad (1)$$

This relationship is established when the operation proceeds from a state as shown in FIG. 5 to a state as shown in FIG. 6; and in the same manner, from a state as in FIG. 6 to a state as in FIG. 7.

On the other hand, the portions of the ink sheet 2 positioned between adjacent thermal heads 3a, 3b, 3c are guided in a direction away from the print sheet 5. Accordingly, a relationship between L and S is represented as follows.

$$S>L \quad (2)$$

After all, by setting each value so as to satisfy the above equations (1) and (2), the interval L, that is a length between adjacent ones of thermal heads 3a, 3b, 3c, can be shortened compared to that in conventional apparatus and thus the recording apparatus can be miniaturized. In other words, by the above mentioned construction, a longer picture in a conveying direction of the print sheet can be formed without causing the apparatus to become larger in size. In order to obtain this advantage, an improvement of performance of multi-transfer of the ink sheet is not required.

Next, a description will be given of an operation of conveyance of the ink sheet 2 performed before the next recording operation starts, after a picture recording operation onto one print paper 5 is complete.

FIG. 7 shows a state of the ink sheet 2 and the print sheet 5 where the conveyance of the ink sheet 2 is stopped after one picture 5a has been formed on the print sheet 5. The ink sheet 2 has one set of color regions comprising three colors.

The print sheet 5 is conveyed a distance 2*L during a period of time starting when a rear end 5a of the print sheet 5 passes the first thermal head 3a and an operation of recording the first color picture is completed by the thermal head 3a and ending when the print sheet 5 reaches a position as shown in FIG. 7. In the same period of time, the ink sheet 2 is conveyed 1/n of conveyed distance of the print sheet 5, that is, 2*L/n. In other words, in the state shown in FIG. 7, a rear end 202a of the first color region 2a of the ink sheet 2 is at a position 2*L/n away from the first thermal head 3a in the downstream side.

In order to start the next recording of a picture onto the next print sheet, it is needed to convey the ink sheet 2 so as to cause it to be in the position shown in FIG. 4. This is performed by winding the ink sheet 2 onto the wind roll 6 and supplying a virgin portion of the ink sheet 2 from the supply roll 1. To achieve this, the ink sheet 2 needs to be conveyed a distance d represented by the following equation in a conveying direction while the recording operation is paused.

$$d=2*A-2*L/n \quad (3)$$

This equation (3) represent the distance when a number of colors is 3. By converting the equation (3) to the general form having m colors, the following equation is obtained.

$$d=(m-1)*A-(m-1)*L/n \quad (4)$$

In this embodiment, as m=3, the equation (3) is obtained by substituting m=3 in the equation (4).

When conveying the ink sheet 2 as mentioned above, it is desired to set the rotation speed of the first and the second driving means to be faster than that used when recording a picture, so as to reduce the conveying time. That is, before starting the next recording of a picture, the ink sheet 2 is conveyed a predetermined distance at a faster speed than that when performing a recording of pictures.

Figure 8:
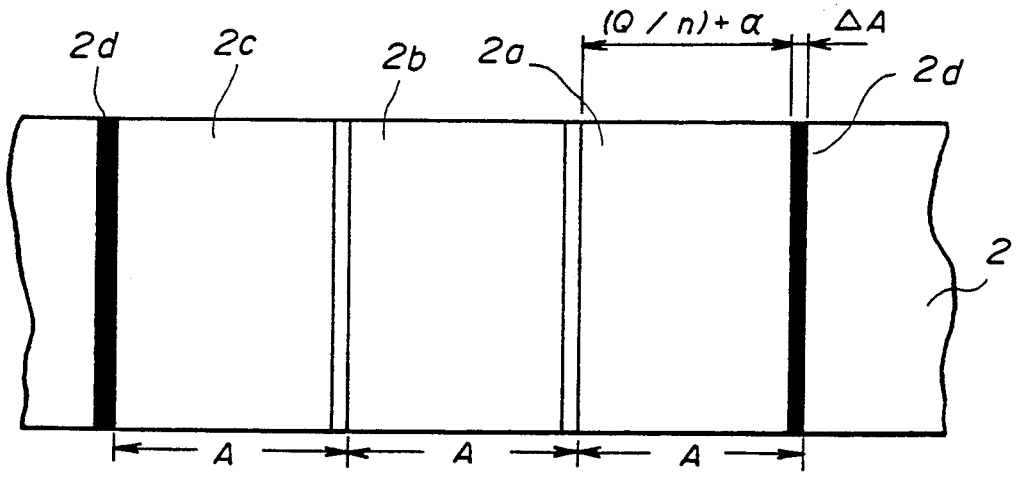
FIG. 8 is a plan view of an ink sheet having a space between each color region.

In order to convey the ink sheet 2 a predetermined distance, a rotation amount of the first driving means 10 may be initially set to a needed amount. Another way is that, as shown in FIG. 8, the first driving means may be stopped by providing a marker 2d on a predetermined position on the ink sheet 2 and then detecting the marker 2d by means of a sensor not shown in the Figure.

Although in this embodiment one picture 5a is recorded on one print sheet 5, a plurality of pictures can be formed on a long print sheet. In such a case, a portion of the long print sheet, corresponding to the rear end 5c of the print sheet 5 shown in FIG. 7, is to be conveyed backward, to the position of the front end 5b of the print sheet 5 shown in FIG. 4, or to a position slightly downstream from that position, and then the next recording of picture can be performed.

Each color region 2a, 2b, 2c, 2a . . . shown in FIG. 2 is arranged in a conveying direction of the ink sheet 2 without having an ink-free space between different color regions. Accordingly, the pitch A of each color region is equal to a conveyed distance of one color region in a conveying direction. In this case, as shown in FIG. 2, the relationship between the pitch A and a length Q of a picture formed on the print sheet 5 measured in a conveying direction, is represented by A=Q/n.

On the other hand, the ink sheet 2 shown in FIG. 2 has an ink-free space A between each color region 2a, 2b, 2c, . . . , thus the pitch A of each color region is represented by A=(Q/n)+A.

Additionally, since a value n may fluctuate, the length of each color region in a conveying direction may be formed slightly larger than Q/n. On the assumption that this extra length is represented by $\alpha$($\alpha$ ($\alpha>0$), the pitch A of each color region is represented by $A=(Q/n)+\alpha$. In addition to that, if the space A is provided as shown in FIG. 8, A is represented by $A=(Q/n-)+A+\alpha$. The ink sheet 2 shown in FIG. 2 is set as A=0 and $\alpha=0$.

It is to be noted that FIG. 8 shows an example which has markers 2d on the space A.

As mentioned above, in the conventional heat transfer type recording apparatus, the interval L of the thermal heads is related, with a predetermined relationship, to the length of the picture formed on the print sheet. Accordingly, if the value n is constant and the interval L is already set, the length Q of a picture to be formed is automatically determined, and thus various pictures having different lengths cannot be formed by one recording apparatus.

Figure 9:
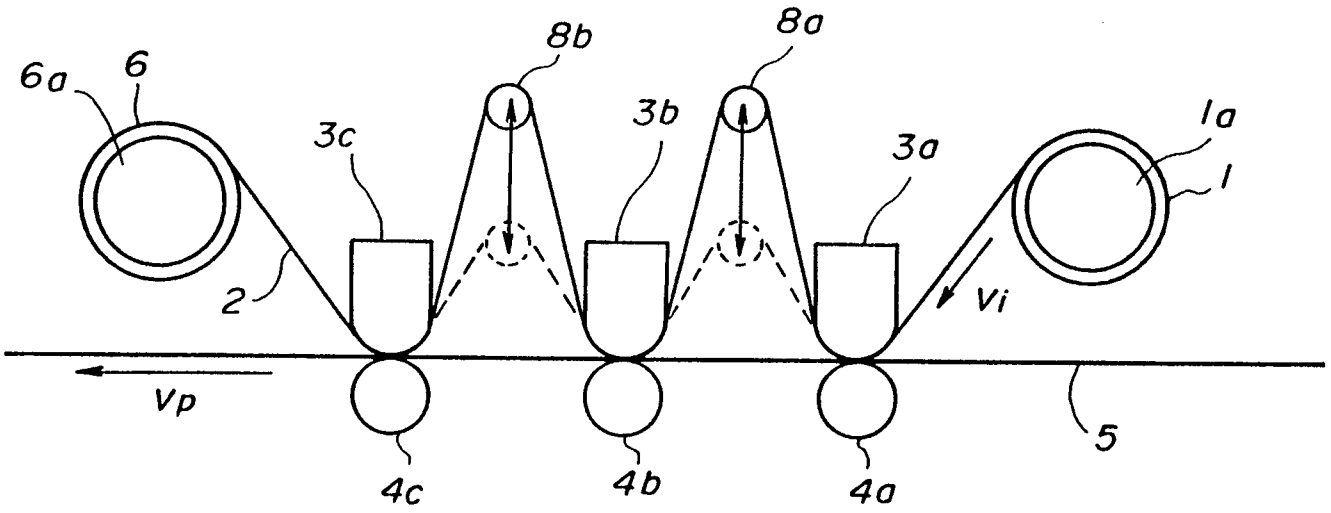
FIG. 9 is a schematic view showing positions of guide rollers 8*a*,8*b*, which positions can be moved in a direction perpendicular to a print sheet.

On the other hand, as shown in FIG. 9, the length of the portions of the ink sheet 2 positioned between adjacent thermal heads 3a, 3b, 3c can be changed due to the provided construction in which each guide roller 8a, 8b that guides the ink sheet 2 positioned between adjacent thermal heads so as to be away from the print sheet 5, is movable in a direction. perpendicular to the face of the print sheet 5. Due to this feature, pictures having various lengths can be formed by one recording apparatus. When recording pictures having various lengths, it is required to use a print sheet having a length sufficient to form those pictures and an ink sheet having a pitch A which satisfies the above mentioned equations (1) and (2). Therefore, by preparing print sheets having various lengths and ink sheets having various pitches of color regions, and setting a height of each guide roller 8a, 8b so as to obtain a value for S which matches the pitch of the color regions, desired pictures having various lengths can be obtained.

In this embodiment, the guide rollers serve two functions, one is as a guide means for guiding the ink sheet 2 so as to be away from the print sheet 5, and the other is as means for changing the length of portions of the ink sheet 2 positioned between each thermal head 3a,3b,3c. Accordingly, an advantage is obtained such that the construction of the recording apparatus becomes simplified. However, means for changing the length of the ink sheet other than as per the above mentioned construction may be used without departing from the scope of the present invention.

Additionally, although the guide rollers 8a,8b are adopted as a guide means for guiding portions of the ink sheet 2 between each thermal head 3a,3b,3c, other guiding members, for example, a plate-like guiding member, can be used instead of the rollers. In this embodiment, two guide rollers 8a,8b are located respectively between each thermal head, that is, one roller is provided between two adjacent thermal heads. However, other constructions may be considered such that a plurality of guiding members are provided between adjacent thermal heads so as to engage with the ink sheet.

In the meantime, according to the present invention, each color region of the ink sheet has a sufficient length in a conveying direction so as to form k pieces of pictures on the print sheet, where k is an integral number equal to or larger than 1. In the above mentioned embodiment, k is set to 1. That is, each color region 2a,2b,2c of the ink sheet 2, shown in FIG. 2 and FIG. 8, has a length $(Q/n)+\alpha$ ($\alpha \geqq 0$) in a conveying direction, and the color region of FIG. 2 is set as $\alpha=0$. Due to this feature, one picture 5a having the length Q as shown in FIG. 2 can be formed by using a set of three color regions 2a,2b,2c. All of the one set of color regions 2a,2b,2c is used in one recording picture operation.

Figure 10:
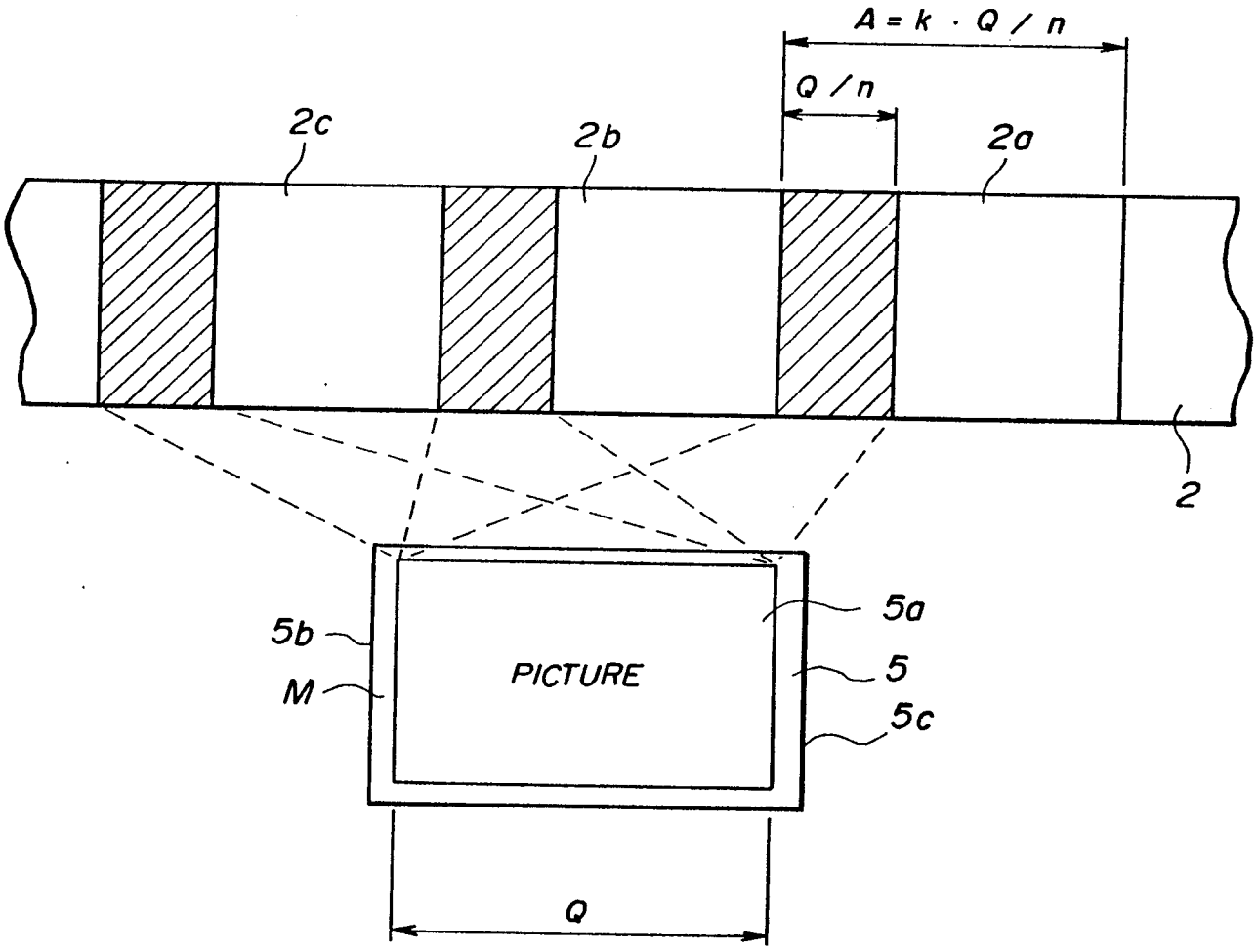
FIG. 10 is a view for explaining a relationship between color regions of an ink sheet and a recorded picture of a second embodiment according to the present invention.

A second embodiment according to the present invention will be described below, in this embodiment k is set as $k \geqq 2$, and each color region of the ink sheet has a sufficient length so as to form k pieces of pictures in a conveying direction. An example of such an ink sheet is shown in FIG. 10. This ink sheet 2 is set as $m=3$, and three color regions are repeatedly provided in a conveying direction of the ink sheet 2. There is no color region provided between each color region 2a,2b,2c . . . , that is, $A=0$ (refer to FIG. 8). Accordingly, the pitch A of each color region 2a,2b,2c . . . , is equal to a length of each color region in a conveying direction of the ink sheet. Q, shown in FIG. 10, is also equal to the length of the picture 5a of the print sheet 5 in a conveying direction of the print sheet.

The difference between this ink sheet and the ink sheet shown in FIG. 2 is that the pitch A of each color region 2a,2b,2c is represented by $A=k*Q/n$ ($k \geqq$). In the ink sheet shown in FIG. 2, k is set as $k=1$, that results in $A=Q/n$.

The structure of the recording apparatus of the second embodiment is the same as that of the first embodiment, and the description thereof will be omitted. Additionally, a picture recording operation is basically the same as that of the first embodiment, as shown in FIG. 11 to FIG. 14.

Figure 11:
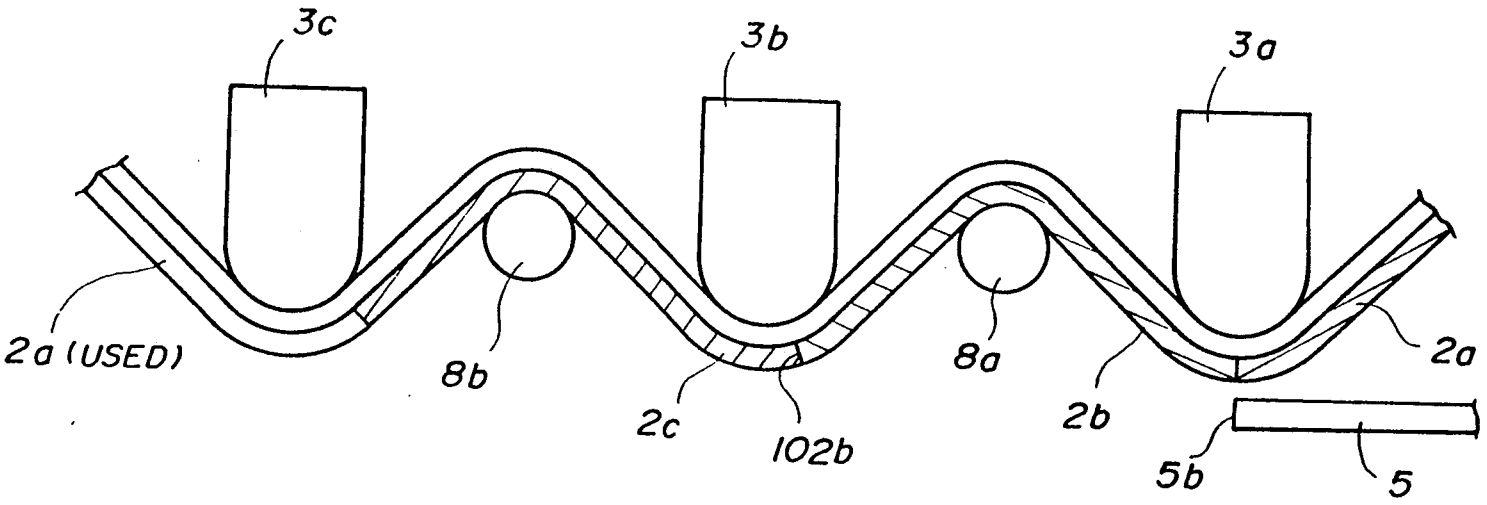
FIG. 11 is a view for explaining an operation of a second embodiment according to the present invention.

FIG. 11 to FIG. 14 are views for explaining a consecutive operation of forming the picture 5a. FIG. 11 (corresponding to FIG. 4) shows a state where a front end 5b of the print sheet 5 is conveyed between the thermal head 3a and the platen 4a (refer to FIG. 1) so as to start a recording operation. The print sheet 5 is conveyed at a speed Vp and the ink sheet 2 is conveyed at a speed Vi, both in a direction indicated by an arrow ($Vp/Vi=n$; $n>1$). The heat generating elements of the first thermal head 3a selectively generate heat so as to transfer an amount of ink of the first color onto the print sheet 5.

Figure 12:
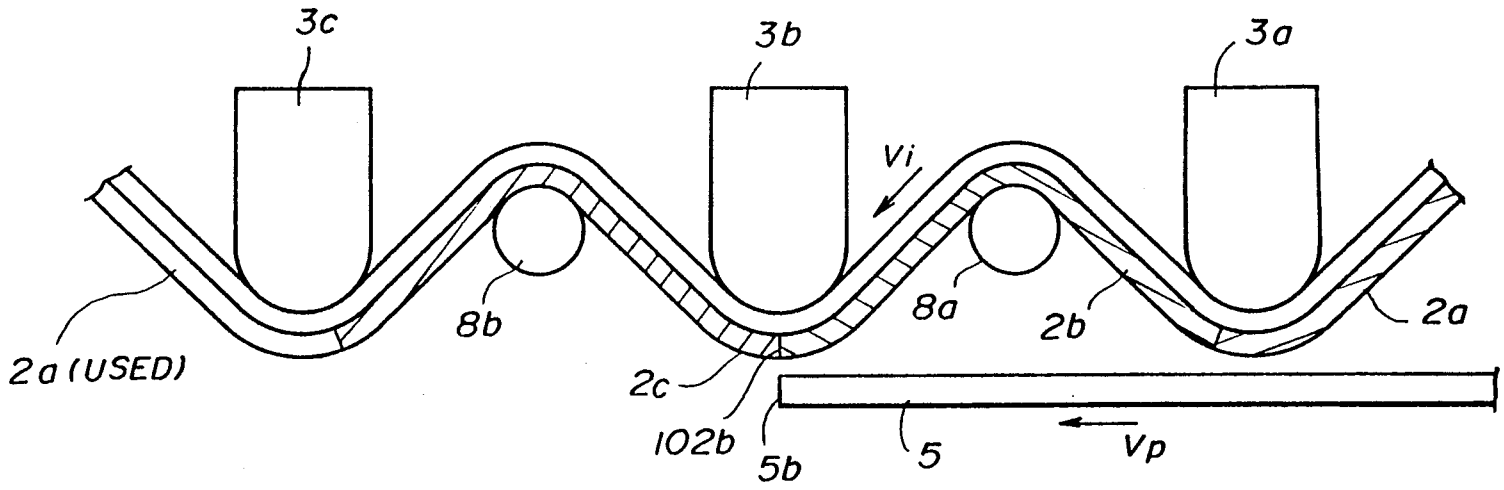
FIG. 12 is a view for explaining an operation of a second embodiment according to the present invention.
Figure 13:
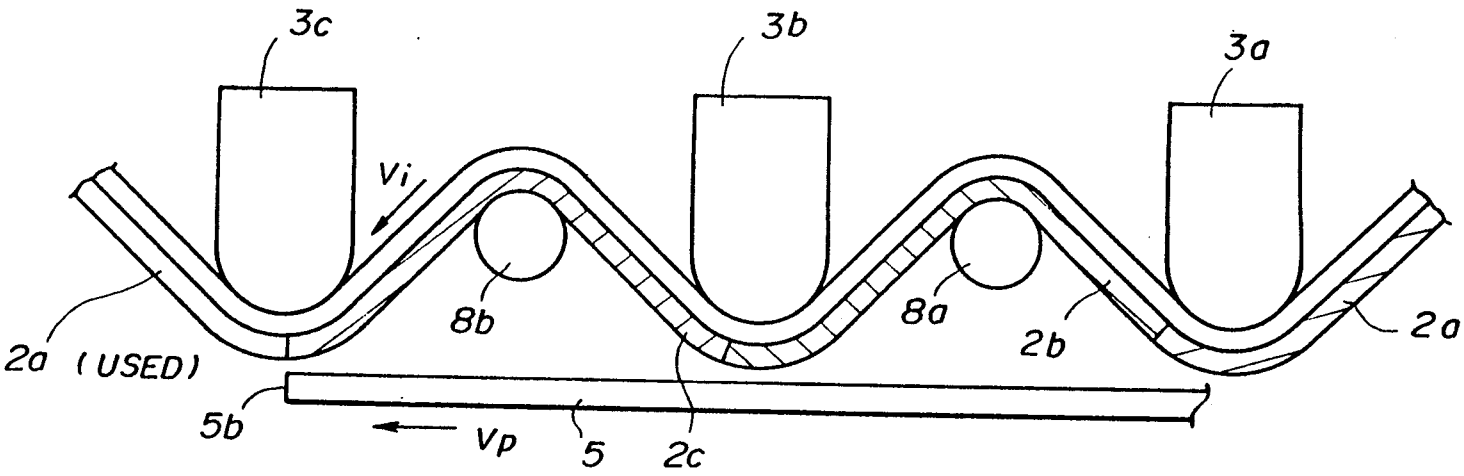
FIG. 13 is a view for explaining an operation of a second embodiment according to the present invention.
Figure 14:
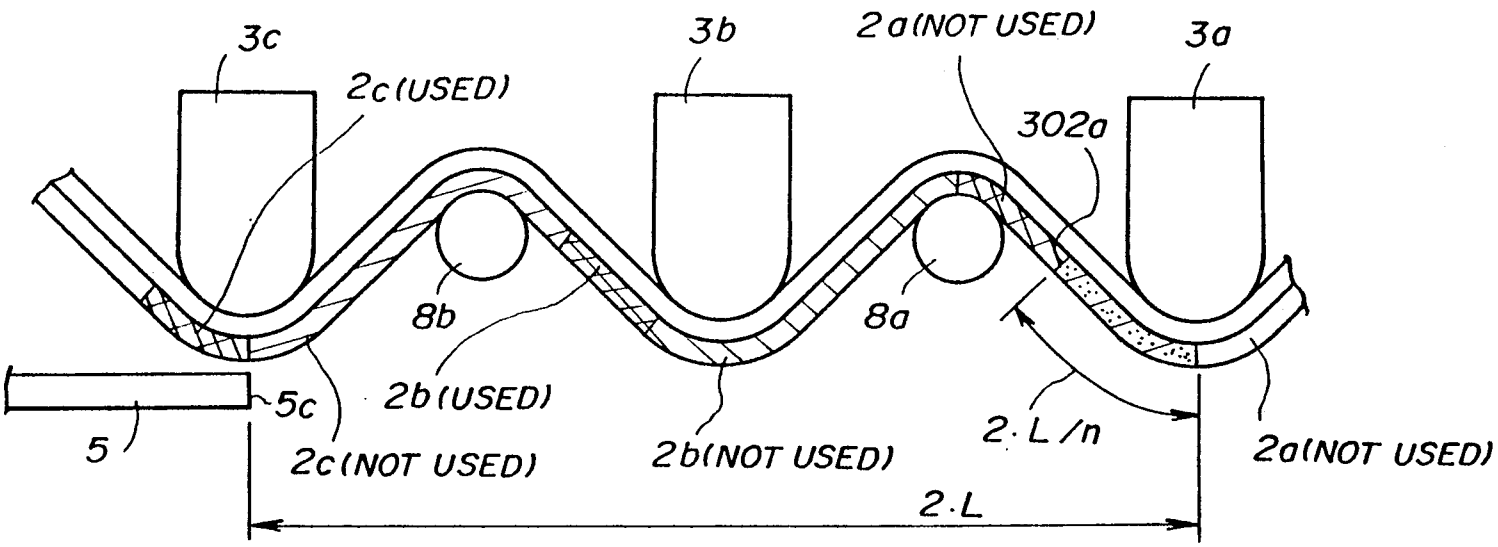
FIG. 14 is a view for explaining an operation of a second embodiment according to the present invention.

FIG. 12 (corresponding to FIG. 5) shows a state where the front end 5b of the print sheet 5 is conveyed between the second thermal head 3b and the platen 4b (refer to FIG. 1). FIG. 13 (corresponding to FIG. 6) shows a state where the front end 5b of the print sheet 5 reaches a position between the third thermal head 3c and the platen 4c (refer to FIG. 1) so as to start a recording of a picture by the third color region 2c. FIG. 14 (corresponding to FIG. 7) shows a state where the rear end 5c of the print sheet 5 reaches a position right under the thermal head 3c and the recording operation is complete.

In the description along FIG. 11 to FIG. 14, it is assumed that the picture comprises the entire portion from the front end 5b to the rear end 5c of the print sheet 5, for simplicity of description. Usually, as shown in FIG. 10, the print sheet 5 has a margin M on its periphery and a picture is formed inside the margin M. Further, in FIG. 11 to FIG. 14, three color regions 2a,2b,2c used for one recording operation are indicated by a shaded area. It is to be noted that in this embodiment, the shaded color regions 2a,2b,2c are used k times per recording operation.

While the operation proceeds from FIG. 11 to FIG. 12, the print sheet 5 is conveyed a distance equal to the interval L between the thermal heads 3a and 3b. Meanwhile, the ink sheet 2 is conveyed a distance of L/n because its conveying speed Vi is 1/n of the conveying speed Vp of the print sheet 5. At the same time, the second color region 2b, positioned between the thermal heads 3a and 3b, is conveyed until its front end 102b reaches between the thermal head 3b and the platen 4b. Now, the length of the second color region 2b, positioned between the thermal heads 3a and 3b, is represented by A, and a length of the portion of the ink sheet 2 positioned between the thermal heads 3a and 3b, is represented by S. Similarly to the first embodiment mentioned above, the following equation is established between the length S and the length L.

$$L/n=S-A \tag{1a}$$

As mentioned above, the portions of the ink sheet 2 positioned between adjacent ones of thermal heads 3a,3b,3c are guided by the guide rollers 8a,8b in a direction away from the print sheet 5. Accordingly, a relationship between L and S is represented as follows.

$$S>L \tag{2a}$$

Similarly to the first embodiment, by setting each value so as to satisfy the above equation (1a) and (2a), the interval L, that is a length between adjacent ones of thermal heads 3a,3b,3c, can be shortened as compared to that of the conventional apparatus and thus the recording apparatus according to the present invention can be miniaturized.

FIG. 14 shows a state where forming of one picture on the print sheet 5 is complete. The shaded set of color regions is not entirely used, but 1/k ($k \geqq 2$) of the pitch A of each color region 2a,2b,2c is used by the operation of forming one picture, as described with reference to FIG. 11 to FIG. 14. In FIG. 14, the portions used by the operation of forming one picture are indicated by a double shaded area. In FIG. 10, those portions are indicated by shaded area (the same in FIG. 16).

In this embodiment, unlike in the first embodiment, since the ink sheet 2 is used in the manner mentioned above, an operation performed before starting the next operation becomes as follows.

The print sheet 5 is conveyed a distance 2*L from the time starting when a rear end 5c of the print sheet 5 passes the first thermal head 3a and an operation of recording the first color picture is complete by the thermal head 3a and ending when the print sheet 5 reaches a position shown in FIG. 14. In the same period of time, the ink sheet 2 is conveyed 1/n of the conveyed distance of the print sheet 5, that is, 2*L/n. In other words, a virgin ink-sheet portion of length 2*L/n is left in the first color region of the ink sheet 2 in a downstream side of the thermal head 3a (in FIG. 14, this portion is indicated by a dotted area). Accordingly, the next operation will be started after rewinding the ink sheet 2 by a length d, represented by the following equation, on the supply roll (refer to FIG. 1).

$$d=2*L/n \tag{5}$$

Due to this rewind, a front end 302a of the virgin portion of the first color region 2a returns to a position right under a tip of the thermal head 3a.

By converting the equation (5) to the general form having m colors, the following equation is obtained.

$$d=(m-1)*L/n \quad (6)$$

Therefore, when starting the next operation of forming a picture with an ink sheet having m colors, a length represented by the equation (6) has to be conveyed in a reverse direction of the conveying direction of the ink sheet.

As mentioned above, although each color region 2a,2b,2c. . . has a length sufficient to form a plurality of pictures, the ink sheet is to be rewound only a small length after one operation of forming a picture is complete. Accordingly, forming of wrinkles on the ink sheet 2 can be reduced, and an increase of recording time can be presented.

When conveying the ink sheet in a reverse direction of the conveying direction of recording, by having the supply roll 1 driven in reverse direction and applying a tension to the ink sheet 2 by means of the tension applying means 11, the ink sheet can be conveyed in a reverse direction while effectively reducing forming of wrinkles on the ink sheet. This operation can be achieved by reversely driving the first driving means 10 coupled to the supply roll 1 and having the second driving means coupled to the tension applying means stopped.

In this case, it is desired that the ink sheet be conveyed faster than during recording of a picture by having a rotation speed of the first driving means be faster than the speed when recording a picture so that a time for winding the ink sheet is reduced.

Figure 16:
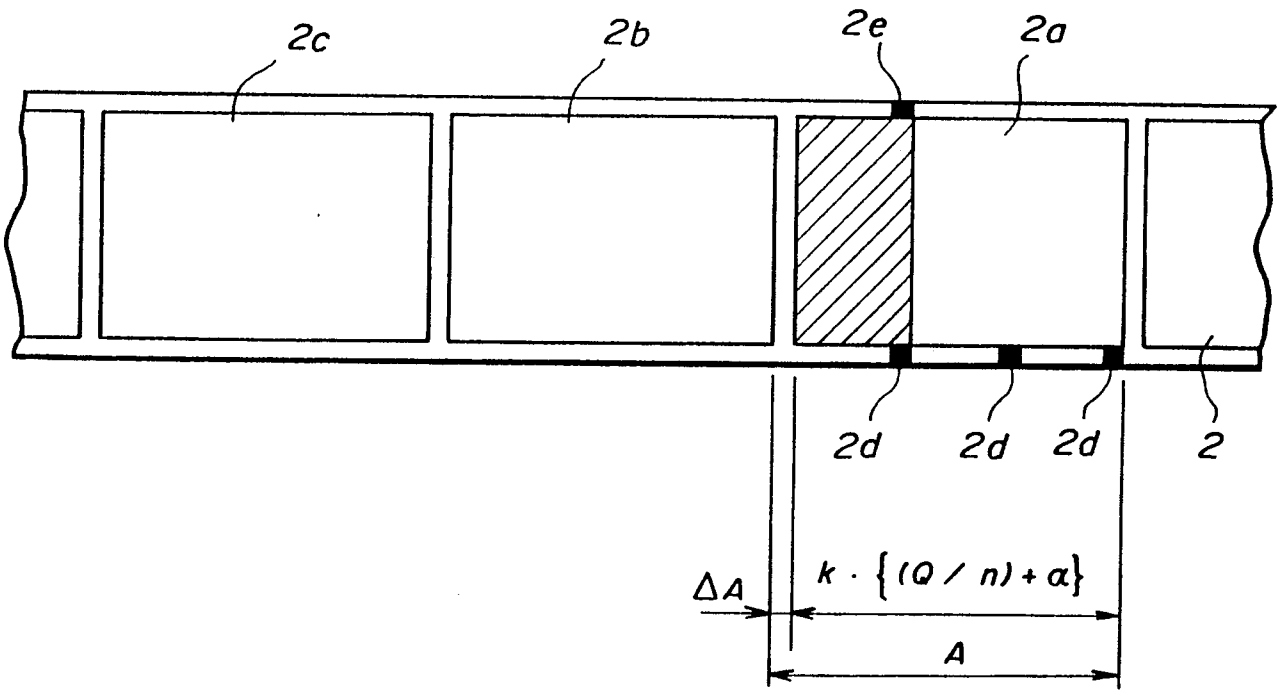
FIG. 16 is a plan view of another example of an ink sheet used with the second embodiment.

In order to rewind the ink sheet 2 a length mentioned above, similarly to the first embodiment, a rotation amount of the first driving means 10 may be initially set to a predetermined value. Or, as shown in FIG. 16, the first driving means 10 may be stopped by having markers 2d on the ink sheet at positions corresponding to every single picture, and detecting them by means of a sensor. In an example shown in FIG. 16, the markers 2d are provided in a margin M that is provided at an end of a width area of the ink sheet 2 and not used for recording.

As mentioned above, repeatedly performing the recording operation and the rewinding operation of the ink sheet 2, k pieces of pictures can be formed by entirely using one set of color regions 2a,2b,2c. It is understandable by considering the pitch A that the ink sheet 2 shown in FIG. 10 and FIG. 16 has k set to k=3.

After one set of color regions 2a,2b,2c is entirely used, the ink sheet 2 has to be supplied from the supply roll 1 and has to be set to a state shown in FIG. 11 so that the next set of color regions becomes available for use in performing the next recording of a picture.

Figure 15:
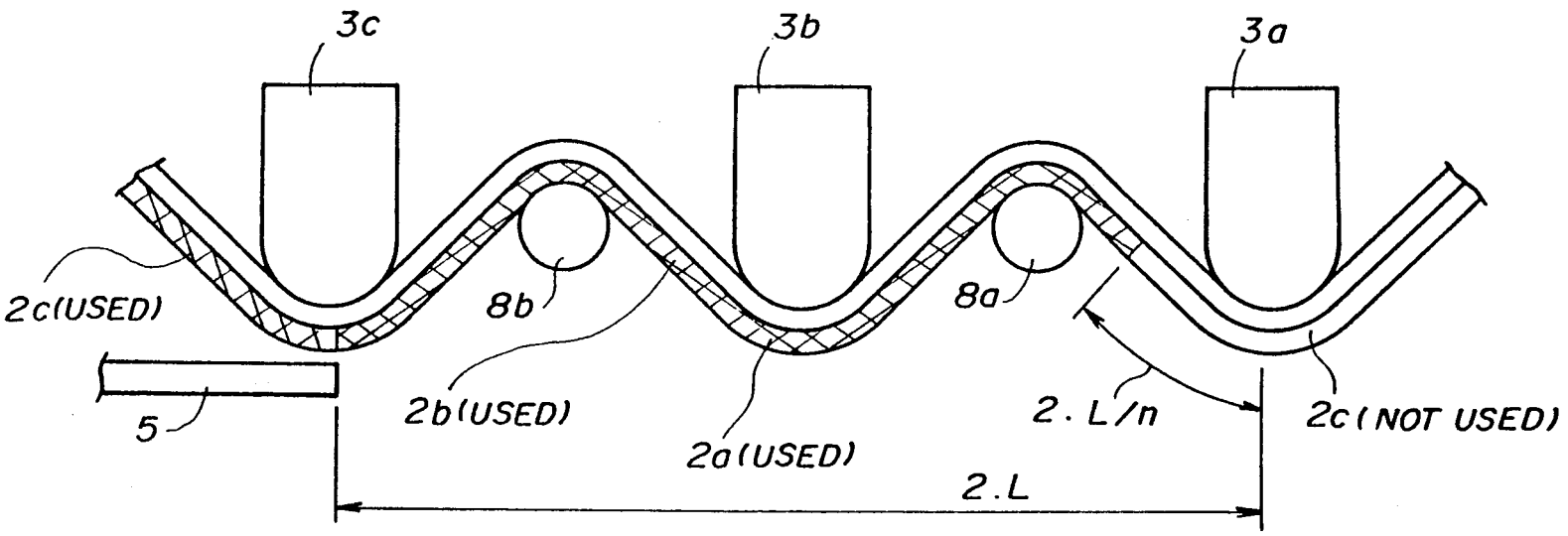
FIG. 15 is a view for explaining an operation of a second embodiment according to the present invention.

FIG. 15 shows a state where a recording on the print sheet 5 is complete by using one set of color regions, and conveyance of the ink sheet 2 is stopped. The color regions already used, in FIG. 15, are indicated by a double shaded area. In this state, similarly to the first embodiment shown in FIG. 7, the rear end 202a of the first color region 2a of the ink sheet 2 is located at a position 2*L/n downstream from the thermal head 3a. Accordingly, the ink sheet 2 is conveyed a distance 2*A−2*L/n in a direction the same as the conveying direction during recording of a picture. That is, the ink sheet 2 is wound on the wind roll 6 while supplying a virgin portion of the ink sheet from the supply roll 1 so as to position each color region in a state as shown in FIG. 11.

When an ink sheet having one set of color regions, which comprises m colors, is used, the ink sheet should be conveyed a length d represented by the following general equation in a direction the same as the conveying direction during recording, before starting the next recording.

$$d=(m-1)*A-(m-1)*L/n \quad (4a)$$

In this embodiment m is set to m=3.

In this case, in order to reduce a recording time, rotation speed of the first and the second driving means 10,12 is set faster than that used when recording a picture. That is, before starting the next recording of a picture, the ink sheet is conveyed at a faster speed than that used when recording a picture, until the ink sheet reaches a predetermined position.

In order to convey the ink sheet 2 as mentioned above, a rotation amount of the first driving means 10 may be initially set to a predetermined value. Or, as shown in FIG. 16, the first driving means 10 may be stopped by having markers 2e at the end of every set of color regions comprising m colors on the ink sheet, and detecting them by means of a sensor, not shown in the figure. Those markers 2e are also provided in a margin which is provided at an end of the width direction of the ink sheet 2 and which portion is not used for recording.

In the ink sheet 2 shown in FIG. 10, like in that of FIG. 2, since the color regions 2a,2b,2c. . . are arranged without having a space A between each other in a conveying direction, the pitch A of the color regions is equal to a length of each color region in a conveying direction of the ink sheet. In this case, the pitch A is represented by A=k*Q/n. In addition to that, if the space A is provided as shown in FIG. 16, A is represented by A=k*{(Q/n)+α}+A. The ink sheet 2 shown in FIG. 10 has A set to A=0 and α set to α=0.

Figure 17:
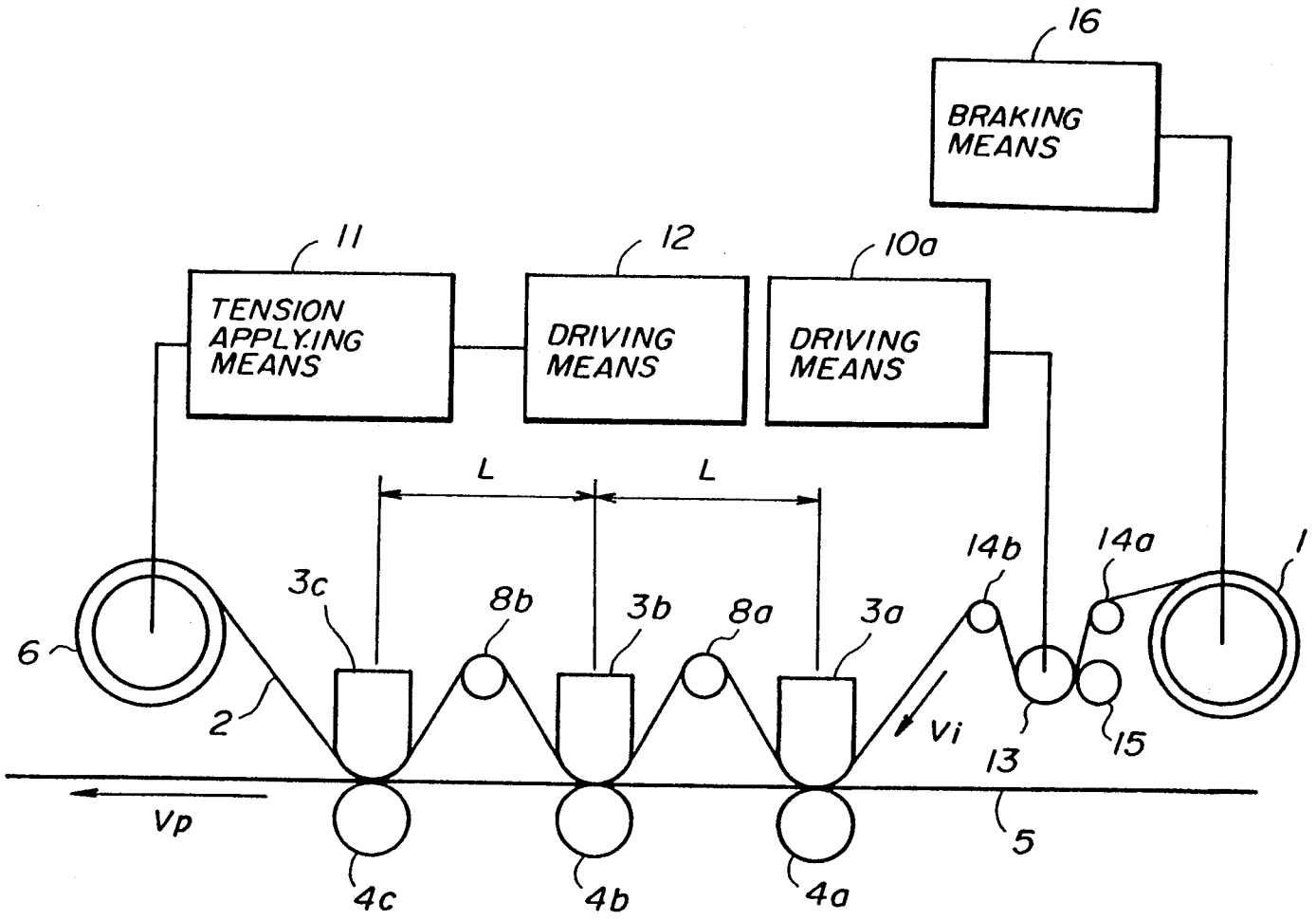
FIG. 17 is a schematic view of a third embodiment according to the present invention.

A capstan roller mechanism can be applied to the structure of the first and the second embodiment. A description will now be given, with reference to FIG. 17, of a third embodiment which adopts a capstan roller.

In this embodiment, portions of the ink sheet 2 positioned between adjacent ones of thermal heads 3a,3b,3c are guided by guide rollers 8a,8b so as to be away from the print sheet 5. In this case, like in other embodiments, the ink sheet 2 is supplied from the supply roll 1 and is wound on the wind roll 6 via the guide rollers 8a,8b.

Portions in the structure of this embodiment that are different portions of earlier embodiments are a capstan roller 13, to which the ink sheet 2 is engaged, provided between the supply roll 1 and the first thermal head 3a; a first driving means 10a, provided in order to drive the capstan roller 13; and a braking means 16, provided for applying a brake force to the supply roll 1. There is no driving means connected to the supply roll 1. Similarly to other embodiments, the second driving means 12 is provided to drive the wind roll 6 via the tension applying means 11.

The ink sheet 2 supplied from the supply roll 1 is guided by two guide rollers 14a,14b and engaged with the capstan roller 13 at a predetermined angle. The supply roll 1 is directly coupled to the braking means comprising a brake and a clutch so as to receive a braking force. The capstan roller 13, comprising a metal shaft with a high friction material such as rubber provided around the shaft, is directly coupled to and is driven by the first driving means 10a comprising a stepping motor or a DC motor, an encoder and a reduction mechanism. The wind roll 6 is driven by the second driving means 12 via the tension applying means 11 comprising such a clutch.

When tension is applied to the ink sheet 2 between the supply roll 1 and the wind roll 6 by the rotation of the wind roll 6, the ink sheet 2 is pressed onto the capstan roller 13. A pinch roller 15, pressed onto the capstan roller 13 by a forcing means such as a spring, is provided so as to pinch the ink sheet 2 between the pinch roller 15 and the capstan roller 13. When the capstan roller 13 is driven by the first driving means 10a, a friction force is generated between the ink sheet 2 and the capstan roller 13 due to the pressing force of the pinch roller 15 and the pressing force caused by tension of the ink sheet 2. Accordingly, the ink sheet is conveyed at the same speed as a circumference speed VR of the capstan roller 13.

Similarly to the first embodiment, the wind roll 6 rotates faster than the circumference speed VR of the capstan roller 13 when no tension is applied to the ink sheet 2 or when the ink sheet 2 is not loaded. That is, on the assumption that a circumference speed of the wind roll 6 is represented by VF, VF is larger than VR (VF>VR) in a state where no ink sheet in loaded. The circumference speed VB of the supply roll 1, which is not connected to a driving means, is zero (VB=0) in a state where no ink sheet is loaded.

When recording a picture, the ink sheet 2 is conveyed at a speed Vi, which is equal to the circumference speed VR of the capstan roller 13. The wind roll 6 winds the ink sheet 2 while applying a tension to the ink sheet 2. The supply roll 1 rotates and supplies the ink sheet while applying tension to the ink sheet due to the braking force of the braking means 16. Accordingly, when recording a picture, VF=VR=VB=Vi is satisfied.

In the third embodiment, since the ink sheet is conveyed at the circumference speed of the capstan roller 13, unlike the first and the second embodiments, the conveying speed of the ink sheet 2 is maintained at constant speed without being affected by a diameter change of the supply roll 1.

It is to be noted that other constructions such as a structure of the ink sheet 2, a relationship between the interval of each thermal head and the length S of the ink sheet 2, and an operation of recording a picture are the same as that of the first or second embodiment.

In the above mentioned embodiments, although the print sheet 5 is conveyed along a straight line between adjacent ones of thermal head 3a, 3b, 3c, the print sheet 5 may be guided by guide means such as guide rollers as shown in FIG. 1. In this case, a conveying length between adjacent thermal heads is not equal to the interval between the thermal heads. This is the same when using a drum shaped platen and arranging thermal heads along the circumference of the platen as shown in FIG. 1. By adopting such a structure, intervals between the thermal heads can be further shortened, and thus the size of the recording apparatus can be further reduced.

The present invention is not limited to the specifically disclosed embodiments, and variations and modifications may be made without departing from the scope of the present invention.

What is claimed is:

1. A transfer-type recording apparatus used with an ink sheet on which color regions comprising m colors are repeatedly formed in a predetermined order and records a picture by transferring the m colors onto a print sheet, this recording apparatus comprises:

a first conveying means conveying said print sheet;

a second conveying means conveying said ink sheet at 1/n of a conveying speed of said print sheet in a conveying direction of said print sheet, where n is a number larger than 1;

m number of recording heads, provided at predetermined intervals in a conveying direction of said print sheet, transferring each of said m colors of said ink sheet onto said print sheet while pressing said ink sheet onto said print sheet, where m is an integer equal to or larger than 2; and a guiding means for guiding portions of said ink sheet positioned between adjacent pairs of said recording heads so as to be away from said print sheet;

wherein, each of said color regions of said ink sheet has a length sufficient to form k number of pictures in the conveying direction of said print sheet, where k is an integer equal to or larger than 1, and the following relations are satisfied, $$S>L$$

$$L=n*(S-A)$$

where,

L is a distance between adjacent ones of said recording heads,

S is a length of a portion of said ink sheet positioned between adjacent pairs of said recording heads, and A is a pitch of said color regions of said ink sheet in the conveying direction of said print sheet.

2. The recording apparatus as claimed in claim 1, wherein said second conveying means conveys said ink sheet a length d in the conveying direction of said print sheet, the length d being given by the following equation, $$d=(m-1)*A-(m-1)*L/n$$

conveying being performed after recording of k number of pictures has been completed and before starting a next recording operation.

3. The recording apparatus as claimed in claim 1, wherein said second conveying means conveys said ink sheet a length d in a reverse direction of the conveying direction of said print sheet, the length d being given by the following equation, $$d=(m-1)*L/n$$

conveying being performed after recording of one picture has been completed, where k is an integer equal to or larger than 2, and before starting a next recording operation.

4. The recording apparatus as claimed in claim 2, wherein said second conveying means conveys said ink sheet a length d in a reverse direction of the conveying direction of said print sheet, the length d being given by the following equation, $$d=(m-1)*L/n$$

conveying being performed after recording of one picture has been completed, where k is equal to or larger than 2, and before starting a next recording operation.

5. The recording apparatus as claimed in claim 2, wherein said second conveying means conveys said ink sheet, after a recording operation of one picture has been completed and before a next recording operation is started, at a speed faster than a conveying speed used while a recording operation is performed.

6. The recording apparatus as claimed in claim 3, wherein said second conveying means conveys said ink sheet, after a recording operation of one picture has been completed and before a next recording operation is started, at a speed faster than a conveying speed used while a recording operation is performed.

7. The recording apparatus as claimed in claim 1, wherein said second conveying means comprises:

a supply roll on which said ink sheet is wound, located on an upstream side of said recording heads;

a first driving means for rotationally driving said supply roll;

a wind roll, located on a downstream side of said recording heads, for winding said ink sheet;

a second driving means for rotationally driving said wind roll; and a tension applying means, coupled to said second driving means and said wind roll, for applying a tension to said ink sheet;

wherein, when performing a recording operation, $VF=VB=Vi$ is satisfied, and when no ink sheet is loaded, $VF>VB$ is satisfied, where VB is a circumference speed of said supply roll, VF is a circumference speed of said wind roll, and Vi is a conveying speed of said ink sheet.

8. The recording apparatus as claimed in claim 7, wherein a value of said k is equal to or larger than 2 and said first driving means reversely drives said supply roll and said second driving means stops driving said wind roll, after one recording operation is complete and before an next picture recording operation is started.

9. The recording apparatus as claimed in claim 1, wherein said second conveying means comprises:

a supply roll on which said ink sheet is wound, located on an upstream side of said recording heads;

a capstan roller, located between said supply roll and said recording heads, engaged with said ink sheet supplied from said supply roll;

a first driving means for driving said capstan roller;

a braking means, coupled to said supply roll, for applying a braking force to said supply roll;

a wind roll, located on a downstream side of said recording heads, winding said ink sheet;

a second driving means for rotationally driving said wind roll; and a tension applying means, coupled to said second driving means and said wind roll, for applying a tension to said ink sheet.

10. The recording apparatus as claimed in claim 1, wherein said guiding means includes means for changing a length of a portion of said ink sheet positioned between adjacent pairs of said recording heads.

11. The recording apparatus as claimed in claim 1, wherein said guiding means comprises a guide roller rotatable in either clockwise or counterclockwise directions.

12. The recording apparatus as claimed in claim 11, wherein a position of said guide roller is movable in a direction perpendicular to a plane of said print sheet.

* * * * *